United States Patent [19]

Konig

[11] 4,060,966

[45] Dec. 6, 1977

[54] APPARATUS FOR SPINNING TEXTILE FIBERS

[75] Inventor: Franz Konig, Linz, Austria

[73] Assignee: Dr. Ernst Fehrer Gesellschaft m. b. H. & Co., K.G. Textilmaschinenfabrik und Stahlbau, Linz, Austria

[21] Appl. No.: 757,589

[22] Filed: Jan. 7, 1977

[30] Foreign Application Priority Data

Feb. 17, 1976 Austria ..... 1121/76

[51] Int. Cl.[2] ..... D01H 1/12

[52] U.S. Cl. ..... 57/58.89; 19/150; 57/58.95

[58] Field of Search ..... 57/50, 58.89–58.95, 57/156; 19/150

[56] References Cited

U.S. PATENT DOCUMENTS

| | | | |
|---|---|---|---|
| 3,635,006 | 1/1972 | Fehrer | 57/50 |
| 3,636,693 | 1/1972 | Benson et al. | 57/58.95 |
| 3,898,788 | 8/1975 | Fehrer | 57/58.89 X |
| 3,913,310 | 10/1975 | Fehrer | 57/58.95 X |
| 3,972,173 | 8/1976 | Fehrer | 57/58.95 X |
| 3,981,137 | 9/1976 | Fehrer | 57/58.95 X |

*Primary Examiner*—John Petrakes
*Attorney, Agent, or Firm*—Kurt Kelman

[57] ABSTRACT

Two juxtaposed drums are arranged to rotate in the same sense and are closely spaced apart to define between them a throat and two gaps tapering towards the throat on opposite sides thereof. The drums are operable to engage flying fibers entering one of the gaps and to twist the fibers together so as to form a twisted yarn. Draw-off rolls are provided for withdrawing the twisted yarn from the throat in the longitudinal directon thereof. A suction duct extends into the other gap and has an inlet slot which extends along the throat.

1 Claim, 2 Drawing Figures

APPARATUS FOR SPINNING TEXTILE FIBERS

Figure 1:
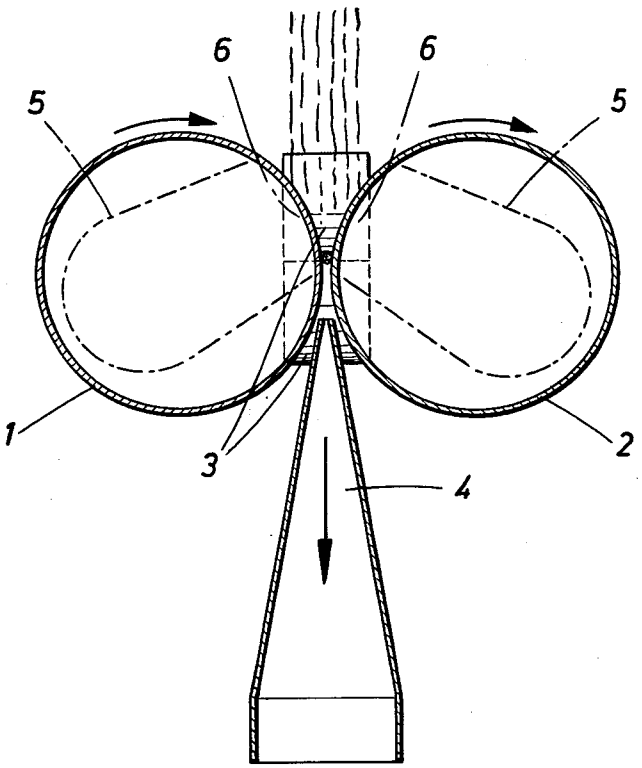

This invention relates to apparatus for spinning textile fibers comprising two juxtaposed drums which are closely spaced apart and rotate in the same sense and define between them two gaps tapering towards a throat which receives flying fibers. The fibers are twisted together in the throat to form a product which is withdrawn in a parallel to the axes direction of said drums and throat while being held against rotation.

In known apparatus of that kind, disclosed in U.S. Pat. No. 3,913,310, the two drums consist of suction drums which have suction zones facing each other and adjoining the tapering gap. Whereas that apparatus has proved fully satisfactory, the need for two suction drums and respective suction inserts involves a rather high expenditure.

It is an object of the invention so to improve the apparatus defined first hereinbefore that the structure is simplified or a higher structural expenditure enables a more favorable twisting action.

This object is accomplished according to the invention in that a suction duct is provided on that side of the drums which is opposite to the side on which the flying fibers are received and the duct has an inlet slot which extends along the throat between the drums and faces the throat between the drums.

Flying fibers to be supplied into the tapering gap between the two drums must be entrained by an air stream. If the drums have inperforate shells, such air stream will rebound from the shell and produce turbulence in the tapering gap. This turbulence prevents a proper twisting of the fibers which are supplied, particularly because the fibers cannot penetrate the tapering gap to a sufficient depth and do not adequately contact the drum shells, by which the fibers are twisted together. The suction duct provided according to the invention causes the entraining air stream to flow through the throat between the drums without turbulence and ensures that the approaching fibers properly contact the drum shells so that the desired twisting action is produced even when the drums have imperforate shells and are not provided with suction inserts so that the structure is simplified. If the suction duct is provided in the known arrangement comprising two suction drums and confronting suction zones, which adjoin the tapering gap, the fibers will be drawn into the gap between the drums to a larger depth so that the friction between the fibers and the resulting yarn, on the one hand, and the drums, on the other hand, is increased and the twisting action is thus improved. For this reason the suction duct having an inlet slot may be used in accordance with the invention in apparatus having simple drums and no additional suction means as well as in conjunction with suction drums. It will be understood that the inlet slot of the suction duct must extend at least along that portion of the length of the drums in which the fibers fly into the tapering gap, although the inlet slot extends suitably beyond that length portion in the direction in which the yarn is withdrawn so that the improved twisting action is exerted also on the yarn which has been formed.

Figure 2:
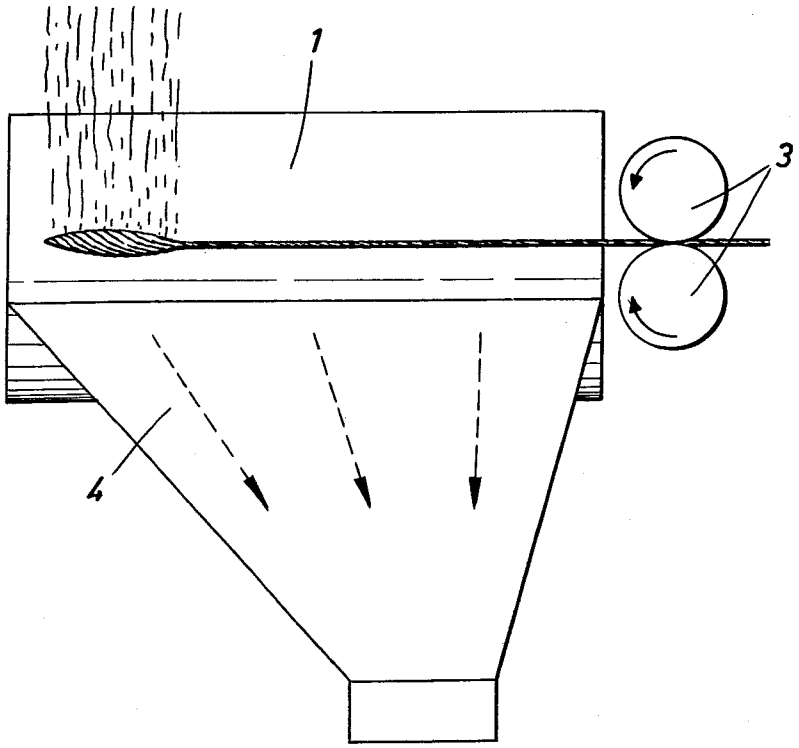

An illustrative embodiment of the invention is shown strictly diagrammatically in the accompanying drawing, in which FIG. 1 is a vertical sectional view showing apparatus for spinning textile fibers and FIG. 2 is a side elevation showing the apparatus with the forward drum omitted.

The apparatus according to the invention comprises two juxtaposed drums 1, 2, which are closely spaced apart and rotate in the same sense, and a pair of draw-off rolls 3 succeeding the drums and disposed at one end thereof. Flying fibers enter between the two drums 1, 2 and are twisted together one of two like gaps tapering towards a throat in the throat by the rotating drums. The apparatus is suitably preceded by a serrated drum, which rotates at high speed and disintegrates the material into individual fibers and ejects the latter so that the air stream produced by the rotation of the serrated drum entrains the fibers and causes them to fly into the one tapering gap between the drums 1, 2. A suction duct 4 extends into the gap opposite the one gap and has an inlet slot extending along the throat between the drums 1, 2 and faces the throat. The suction duct 4 is operable to minimize turbulence in the tapering gap, to withdraw the entraining air stream, and to cause the fibers to firmly contact the shells of the drums 1, 2.

The drums 1, 2 may be suction drums, each of which has a perforated shell and is provided with a suction insert 5, which is indicated in dash-dot lines, so that suction zones 6 are provided, which adjoin the tapering gap and face each other.

What is claimed is:

1. An apparatus for spinning textile fibers, which comprises a. two juxtaposed drums having axes extending parallel to each other and arranged to rotate in the same sense,
   1. the drums being closely spaced apart to define therebetween a throat extending parallel to said axes and two like gaps tapering towards said throat at opposite sides thereof, and
   2. the drums being operable to engage flying fibers entering one of the gaps at one side of the throat and to twist the fibers together in the throat to form a twisted fiber product, b. draw-off means arranged to withdraw the twisted fiber product from the throat in the direction of the throat, and c. a suction duct extending into the other gap at the opposite side of the throat and having an inlet slot extending along and facing the throat.

* * * * *